US005397481A

United States Patent [19]

Mattus

[11] Patent Number: 5,397,481

[45] Date of Patent: Mar. 14, 1995

[54] SUBMERGIBLE TORCH FOR TREATING WASTE SOLUTIONS AND METHOD THEREOF

[75] Inventor: Alfred J. Mattus, Oak Ridge, Tenn.

[73] Assignee: Martin Marietta Energy Systems, Inc., Oak Ridge, Tenn.

[21] Appl. No.: 227,164

[22] Filed: Apr. 13, 1994

Related U.S. Application Data

[62] Division of Ser. No. 924,206, Aug. 3, 1992, abandoned.

[51] Int. Cl.[6] ..... C02F 1/70

[52] U.S. Cl. ..... 210/757; 210/766; 210/903; 423/251; 423/659; 588/19; 588/20

[58] Field of Search ..... 210/903, 749, 757, 766; 423/251, 659; 588/19, 20

[56] References Cited

U.S. PATENT DOCUMENTS

| | | | |
|---|---|---|---|
| 3,006,859 | 10/1961 | Allemann et al. | 588/19 |
| 3,479,295 | 11/1969 | Thompson | 588/19 |
| 3,862,296 | 1/1975 | Dotson et al. | 210/903 |
| 4,990,266 | 2/1991 | Vorlop et al. | 210/757 |
| 5,118,447 | 6/1992 | Cox et al. | 588/20 |
| 5,221,486 | 6/1993 | Fassbender | 210/766 |

FOREIGN PATENT DOCUMENTS

| | | | |
|---|---|---|---|
| 62-11320 | 3/1987 | Japan | 588/19 |

OTHER PUBLICATIONS

Thompson et al, "Fluidized Bed Calcination of Radioactive Wastes Using In-Bed Combustion Heating", *Nuclear Technology*, vol. 16, Nov. 1972 pp. 396–405.

Stinson, Stephen C., "EPA to Evaluate New Technologies For Cleaning Up Hazardous Wastes", *Chemical and Engineering News*, May 25, 1987, pp. 7–12.

*Primary Examiner*—Cynthia L. Nessler

*Attorney, Agent, or Firm*—Ivan L. Ericson; Joseph A. Marasco; Harold W. Adams

[57] ABSTRACT

A submergible torch for removing nitrate and/or nitrite ions from a waste solution containing nitrate and/or nitrite ions comprises: a torch tip, a fuel delivery mechanism, a fuel flow control mechanism, a catalyst, and a combustion chamber. The submergible torch is ignited to form a flame within the combustion chamber of the submergible torch. The torch is submerged in a waste solution containing nitrate and/or nitrite ions in such a manner that the flame is in contact with the waste solution and the catalyst and is maintained submerged for a period of time sufficient to decompose the nitrate and/or nitrite ions present in the waste solution.

12 Claims, 2 Drawing Sheets

SUBMERGIBLE TORCH FOR TREATING WASTE SOLUTIONS AND METHOD THEREOF

This application is a division of application No. 07/924,206, filed Aug. 3, 1992, abandoned.

This invention was made with Government support under contract DE-AC05-84OR21400 awarded by the U.S. Department of Energy to Martin Marietta Energy Systems, Inc. and the Government has certain rights in this Invention.

1. Field of the Invention

The present invention relates to a torch for treating a waste solution and a method thereof. More particularly, the present invention relates to a submergible torch for removing nitrate and/or nitrite ions from a waste solution and a method thereof.

2. Background of the Invention

At facilities where the use of nitric acid is widespread, large amounts of alkaline, nitrate and/or nitrite based wastes are generated. Nitrate and/or nitrite, as a waste species, is very mobile and detrimental to the environment. Therefore, it is very desirable to provide an inexpensive and in situ method to remove nitrate and/or nitrite ions from waste solutions.

OBJECTS OF THE INVENTION

Accordingly, it is an object of the present invention to provide a new and improved submergible torch for removing nitrate and/or nitrite ions from a waste solution.

Accordingly, it is another object of the present invention to provide a new and improved method for removing nitrate and/or nitrite ions from a waste solution utilizing a submergible heat source.

Further and other objects of the present invention will become apparent from the description contained herein.

SUMMARY OF THE INVENTION

In accordance with one aspect of the present invention, a new and improved submergible torch for removing nitrate and/or nitrite ions from a waste solution comprises a torch tip, a fuel delivery mechanism, a fuel flow control mechanism, a catalyst, and a combustion chamber. The torch tip has an orifice, a back portion, and a front portion. The fuel delivery mechanism delivers a fuel from the fuel source to the fuel flow control mechanism. The fuel delivery mechanism has a first end and a second end. The first end of the fuel delivery mechanism is connected to the fuel source. The fuel flow control mechanism controls the flow of the fuel through the orifice of the torch tip. The fuel flow control mechanism has a back portion and a front portion. The back portion of the fuel flow control mechanism is connected to the second end of the fuel delivery mechanism and the front portion of the fuel flow control mechanism is connected to the back portion of the torch tip. The catalyst has a support. The support of the catalyst has a first end and a second end. The first end of the support of the catalyst is connected to the combustion chamber and the second end of the support of the catalyst is connected to the catalyst. The combustion chamber has a closed end and an open end. The open end of the combustion chamber forms a plane. The closed end of the combustion chamber is connected to the back portion of the torch tip and the open end of the combustion chamber is distal from the closed end. The tip portion of the torch tip is positioned a prescribed distance from the plane generated by the open end of the combustion chamber. The catalyst is positioned in close proximity to the tip portion of the torch tip.

In accordance with another aspect of the present invention, a new and improved method for removing nitrate and/or nitrite ions from an waste solution comprising the following steps:

Step 1 - A waste solution comprising water and nitrate and/or nitrite ions and having a surface, a source of heat generating heat, and a catalyst is provided.

Step 2 - The source of heat generating heat and the catalyst is submerged below the surface of the waste solution. The catalyst is located in close proximity to the heat source. The heat source generates a temperature sufficiently high to decompose nitrate and/or nitrite ions contained in the waste solution. The heat source and the catalyst are located sufficiently below the surface of the waste solution to provide a sufficient residence time for gases formed by heating of the waste solution by the heat from the heat source to be sufficiently contacted by the waste solution to remove essentially all volatile waste solution soluble species, if any, and to remove essentially all particles, if any, present in the gases formed by the heat from the heat source before the gases reach the surface of the waste solution.

Step 3 - The heat source generating the heat and the catalyst are maintained below the surface of the waste solution for a period of time sufficient to decompose the nitrate and/or nitrite ions.

In accordance with another aspect of the present invention, a new and improved method for removing nitrate and/or nitrite ions from an waste solution comprises the following steps:

Step 1 - A waste solution is provided. The waste solution comprises water and nitrate and/or nitrite ions and has a surface.

Step 2 - A fuel of a submergible torch is ignited to produce a flame.

Step 3 - The submergible torch is submerged below the surface of the waste solution. The submergible torch comprises a combustion chamber having an open end and containing the flame. A catalyst in close proximity to the flame is connected to the combustion chamber by a support. The flame is in contact with the surface of the waste solution at the open end of the combustion chamber. The flame of the submergible torch has a temperature sufficient to decompose the nitrate and/or nitrite ions in the waste solution. The submergible torch is located sufficiently below the surface of the waste solution to provide a sufficient residence time for gases formed by heating of the waste solution by the flame in contact with the waste solution to be sufficiently contacted by the waste solution to remove essentially all volatile waste solution species, if any, and to remove essentially all particles, if any, present in the gases formed by the heating of the waste solution by the flame before the gases reach the surface of the waste solution.

Step 4 - The submergible torch is maintained below the surface of the waste solution for a period of time sufficient to decompose the nitrate and/or nitrite ions.

For a better understanding of the present invention, together with other and further objects, advantages and capabilities thereof, reference is made to the following disclosure and appended claims.

Figure 1:
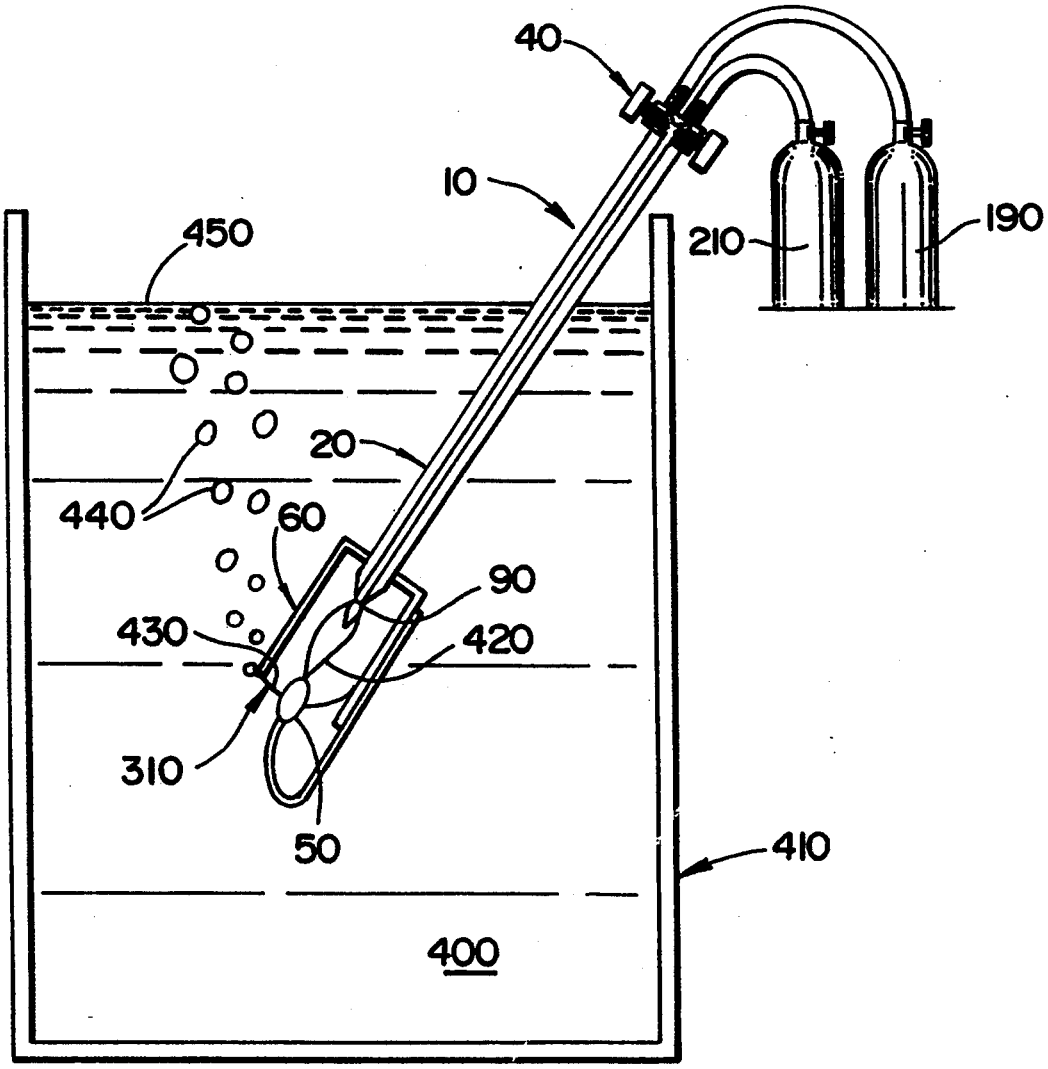
FIG. 1 is a partial cross-sectional view of a submergible torch submerged in a waste solution in accordance with the present invention.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

The present invention provides a new and useful method for decomposing nitrate and/or nitrite ions in waste solutions. The decomposition of nitrate and/or nitrite is usually accomplished thermally by heating a dry nitrate-based and/or nitrite-based salt. Waste streams containing solutions of nitrates and/or nitrites are very common at commercial and federal sites. It is very important to provide an inexpensive and in situ procedure to treat these waste streams. The instant invention is a method which decomposes nitrates and/or nitrites in a waste solution, in situ, such as solutions contained in a storage tank or transfer vessel. The method of the present invention overcomes an additional major problem created by the presence of volatile radionuclides such as cesium 137 if present in the waste solution. The radionuclides are volatilized when the nitrate and/or nitrite ions are decomposed by heat and must be removed from any gases formed. If the gases formed must be treated as a separate processing step it adds substantially to the cost of the processing. In the method of the present invention any volatile species such as radionuclides generated by the decomposition of the nitrate and/or nitrite ions are contacted by the waste solution during the process thereby removing any radionuclides and any other hazardous metals forming volatile species from the generated gases as they rise to the surface of the waste solution. In addition, any insoluble oxides of hazardous metals such as chromium, lead or cadmium formed during the process will settle to the bottom of the waste solution container. This would be specially true for high pH solutions.

One of the preferred methods of the present invention for removing nitrate and/or nitrite ions from a waste solution comprises the following steps:

Step 1 - A waste solution comprising water and nitrate and/or nitrite ions and having a surface, a source of heat generating heat, and a catalyst is provided.

Step 2 - The source of heat generating heat and the catalyst is submerged below the surface of the waste solution. The catalyst is located in close proximity to the heat source. The heat source generates a temperature sufficiently high to decompose nitrate and/or nitrite ions contained in the waste solution. The heat source and the catalyst are located sufficiently below the surface of the waste solution to provide a sufficient residence time for gases formed by heating of the waste solution by the heat from the heat source to be sufficiently contacted by the waste solution to remove essentially all volatile waste solution soluble species, if any, and to remove essentially all particles, if any, present in the gases formed by the heat from the heat source before the gases reach the surface of the waste solution. The heat is maintained at a temperature equal to or greater than the temperature required to decompose the nitrate and/or nitrite ions in the waste solution.

Step 3 - The heat source generating the heat and the catalyst are maintained below the surface of the waste solution for a period of time sufficient to decompose the nitrate and/or nitrite ions. The period of time require to maintain the heat of the submerged heat source in contact with the waste solution is equal to or greater than the time required to decompose the nitrate and/or nitrite ions in the waste solution.

Another of the preferred methods of the present invention for removing nitrate and/or nitrite ions from a waste solution comprises the following steps:

Step 1 - A waste solution is provided. The waste solution comprises water and nitrate and/or nitrite ions and has a surface.

Step 2 - A fuel of a submergible torch is ignited to produce a flame.

Step 3 - The submergible torch is submerged below the surface of the waste solution. The submergible torch comprises a combustion chamber having an open end and containing the flame. A catalyst in close proximity to the flame is connected to the combustion chamber by a support. The flame is in contact with the surface of the waste solution at the open end of the combustion chamber. The flame of the submergible torch has a temperature sufficient to decompose the nitrate and/or nitrite ions in the waste solution. The submergible torch is located sufficiently below the surface of the waste solution to provide a sufficient residence time for gases formed by heating of the waste solution by the flame in contact with the waste solution to be sufficiently contacted by the waste solution to remove essentially all volatile waste solution species, if any, and to remove essentially all particles, if any, present in the gases formed by the heating of the waste solution by the flame before the gases reach the surface of the waste solution. The flame temperature of the submerged torch is maintained at a temperature .equal to or greater than the temperature required to decompose the nitrate and/or nitrite ions in the waste solution.

Step 4 - The submergible torch is maintained below the surface of the waste solution for a period of time sufficient to decompose the nitrate and/or nitrite ions. The period of time require to maintain the flame of the submerged torch in contact with the waste solution is equal to or greater than the time required to decompose the nitrate and/or nitrite ions in the waste solution.

In the methods of the instant invention the flame produced by igniting and burning a fuel of the submergible torch generates heat. The fuel comprises a mixture of an oxygen containing gas such as oxygen or air and a hydrogen or a hydrogen and carbon containing gas such as acetylene, methane, butane, propane, hydrogen, propylene, or any other combustible hydrocarbon gas. The heat generated by the flame does three things: (1)

decomposes some water to oxygen, hydrogen and steam; (2) decomposes nitrate and/or nitrite ions to lower mixed oxides of nitrogen, such as NO(g); and (3) reacts with some metal ions to form oxides, especially at high pH. The reducing portion of the flame impinges upon a catalyst which is in contact with the waste solution. The catalyst, platinum black is platinum on activated charcoal which is mixed with a high temperature sodium silicate furnace cement, dried and heat treated to form a porous matrix containing the platinum on activated charcoal. The insoluble, lower oxides of nitrogen, such as NO(g), formed by the decomposition of the nitrate and/or nitrite ions in the waste solution are known to have a low aqueous solubility, especially under reducing conditions. The lower oxides of nitrogen and any other insoluble gases formed rise to the surface of the waste solution as bubbles of gas and leave the waste solution as gases. These gases generated can be broken up mechanically or by an ultrasonic probe to expose the maximum surface area of the gases to the waste solution to maximize the absorption efficiency of the waste solution for any unwanted volatile species which are soluble in the waste solution such as the volatile species of radionuclides, mercury, or selenium.

Figure 2:
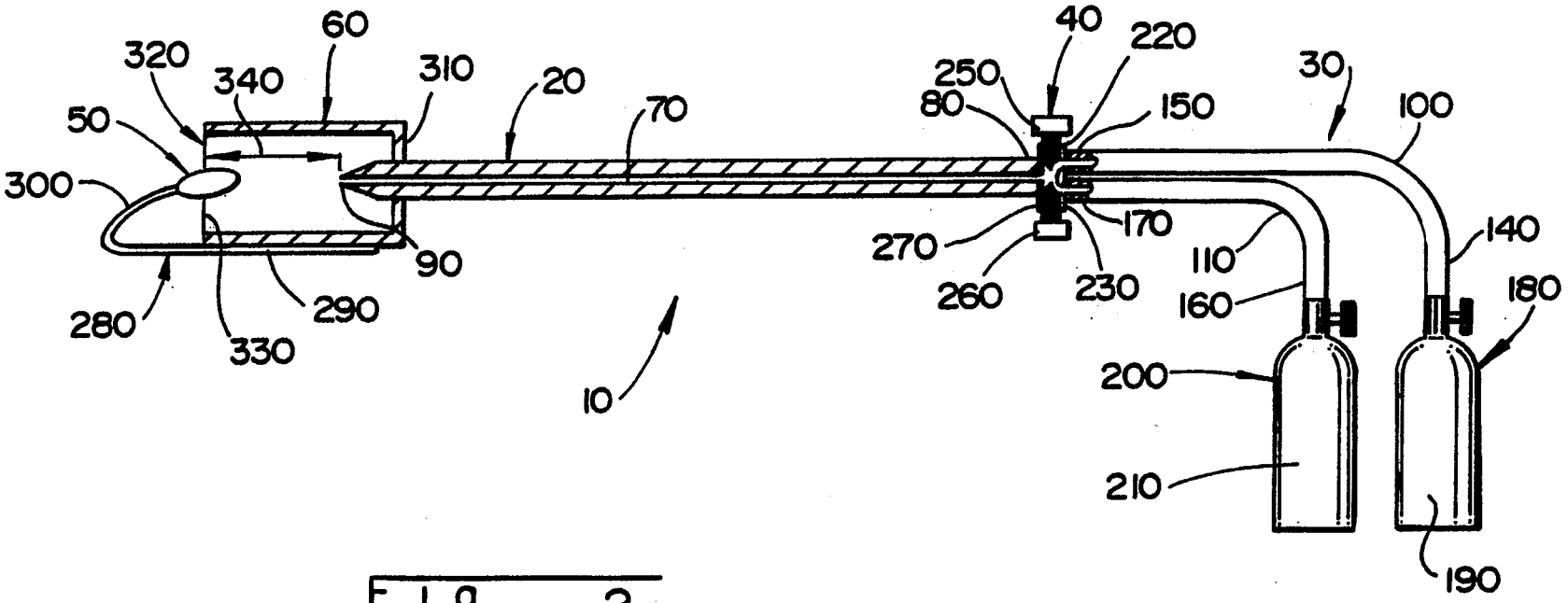
FIG. 2 is a partial cross-sectional view of a submergible torch in accordance with the present invention.

One embodiment of the present invention is shown in FIG. 1. Submergible torch 10, as depicted in FIG. 2, is submerged in waste solution 400 contained in container 410. Flame 420 at tip 90 of torch tip 20 of submergible torch 10 is in contact with surface 430 of waste solution 400 and catalyst 50. The length of flame 420 can be adjusted by controlling the flow of fuels 190, such as oxygen, and 210, such as a hydrogen containing gas selected from the group consisting of acetylene, propane, hydrogen, propylene, and mixtures thereof, by fuel flow control mechanism 40. Distance between tip portion 90 of torch tip 20 and surface 430 of waste solution 400 at open end 310 of combustion chamber 60 can be changed by adjusted the position of combustion chamber 60 in relation to tip portion 90 of torch tip 20. The heat generated by flame 420 decomposes the nitrate and/or nitrite ions contained in waste solution 400 and generates gases which form bubbles 440. Bubbles 440 migrate to surface 450 of waste solution 400. When bubbles 440 migrate to surface 450 any volatile waste solution soluble species, if any, are absorbed by waste solution 400 in contact with bubbles 440. In addition, any particles, if any, present in bubbles 440 are removed by waste solution 400 in contact with bubbles 440.

The submergible torch of the instant invention furnishes the flame and required temperatures for the decomposition of nitrate and/or nitrite ions in the waste solution. It is well known that oxygen-acetylene torches for cutting materials function quite well underwater and produce a maximum flame temperature between approximately 5,800° F. or 3204° C. and approximately 6,300° F. or 3482° C. at the tip of the flame. In the method of the instant invention we take advantage of this-high temperature generated by an oxygen-acetylene torch. The flame temperature is far above the temperature necessary to decompose nitrate/nitrite ions to mixed oxides of nitrogen. For example the decomposition temperature of sodium nitrate is approximately 1,090° F. or 5800° C. At these high temperatures water decomposes to form hydrogen and oxygen. The oxygen can work against the desired reduction of the nitrate and/or nitrite ions to NO(g) as opposed to NO(1) which is essentially zero or other lower oxides of nitrogen by oxidizing them back to nitrate (NO3). The carburizing portion of the oxyacetylene flame can consume the oxygen by forming carbon dioxide from the carbon monoxide generated in the carburizing portion of the flame. The combination of the carburizing portion of the flame and a portion of the catalyst being in contact with the flame and a portion being in contact with the waste solution most likely neutralize the oxidizing potential from the decomposition of the water. It should be pointed out that other sources of heat generated by sources such as ion plasma and electric arc may also work well for this purpose. A torch having the requisite flame temperature is described in U.S. Pat. No. 3,873,028 to Miller and is incorporated herein by reference.

One embodiment of a submergible torch of the instant invention for removing nitrate and/or nitrite ions from a waste solution is shown in FIG. 2. Submergible torch 10 comprises torch tip 20, fuel delivery mechanism 30, fuel flow control mechanism 40, catalyst 50, and combustion chamber 60. Torch tip 20 has an orifice 70, back portion 80, and tip portion 90. Fuel delivery mechanism 30 comprises two flexible fuel hoses 100 and 110 respectively. Flexible fuel hose 100 has first end 140 and second end 150. Flexible fuel hose 110 has first end 160 and second end 170. First end 140 of flexible fuel hose 100 is connected to fuel source 180 which contains fuel 190, such as oxygen. First end 160 of flexible fuel hose 110 is connected to fuel source 200 which contains fuel 210, such as acetylene. Fuel flow control mechanism 40 controls the flow of fuels 190 and 210 through orifice 70 of torch tip 20. Fuel flow control mechanism 40 has hose connection 220, hose connection 230, valve 250, such as a gas control valve, and valve 260, such as a gas control valve. Hose connection 220 of fuel flow control mechanism 40 is connected to second end 150 of flexible fuel hose 100. Hose connection 230 of fuel flow control mechanism 40 is connected to second end 170 of flexible fuel hose 110. Front portion 270 of fuel flow control mechanism 40 is connected to back portion 80 of torch tip 20. Catalyst 50, such as platinum black, reduces gaseous oxides. Catalyst 50 has support 280. Support 280 of catalyst 50 has first end 290 and second end 300. Combustion chamber 60 has closed end 310 and open end 320. Open end 310 forms a plane 330. Closed end 310 of combustion chamber 60 is connected to torch tip 20. Open end 320 of combustion chamber 60 is distal from closed end 310. The position of combustion chamber 60 on torch tip 20 is adjustable. First end 290 of support 280 of catalyst 50 is connected to combustion chamber 60 and second end 300 of support 280 of catalyst 50 is connected to catalyst 50. Tip portion 90 of torch tip 20 is positioned a prescribed distance 340 from plane 330 generated by open end 320 of combustion chamber 60. Catalyst 50 is positioned in close proximity to tip portion 90 of torch tip 20. The position of catalyst 50 is adjustable in relationship to tip portion 90 of torch tip 20.

The lance-like submergible torch of the instant invention provides for ease of entry into tanks having limited space or very small entry ports.

The catalyst such as platinum black is used to help reduce the oxides of nitrogen generated by the decomposition of the nitrate and/or nitrite ions by the heat supplied by the flame to lower, insoluble oxides of nitrogen such as NO(g) or under some conditions to inert nitrogen gas. It should be noted that thermodynamically only lower oxides of nitrogen such as NO(g) are favored at higher temperatures as compared to the higher oxides of nitrogen ($NO_3$, $NO_2$, $N_2O_4$). The intermediate species, nitrite ions, if present will also be reduced similarly to the nitrate ions since the nitrite ion species forms in solution just prior to the insoluble gaseous lower oxides. In addition or alternatively, the gaseous oxides of nitrogen generated can be directed from the combustion chamber to a heated reduction chamber in which ammonia gas is supplied to reduce the mixed oxides of nitrogen to inert nitrogen gas and water vapor for discharge to the environment.

EXAMPLE

A waste solution was prepared by adding sodium nitrate to water to form a solution containing 4 Molar $NaNO_3$. Sodium as the cation was used for the nitrate compound; however, metal cation nitrates or potassium, calcium and other cations can be used. Sodium hydroxide was added to the solution to make the solution alkaline. A tip of an oxy-acetylene torch was fitted with a combustion chamber made from 316 SS tubing and a platinum black catalyst mixed with a high temperature cement forming a porous support for the catalyst was attached to a support wire and attached to the combustion chamber. The catalyst, platinum black, is platinum on activated charcoal. 0.1g of the platinum black was mixed with 1.0g of the high temperature sodium silicate furnace cement. The mixture was placed on one end of the stainless steel support wire, dried at 110° C. and heat treated by a flame to form a porous matrix containing the platinum on activated charcoal on the wire support. The catalyst, platinum on activated charcoal, Lot No. 030697, containing a minimum platinum content of 10%, was obtained from Aldrich Chemical Co., Milwaukee, Wis. 53201. The high temperature sodium silicate furnace cement, Bondex (a trade name of Bondex International) Fireplace & Furnace Cement, was obtained from Bondex International, St. Louis, Mo. 63122. The platinum black catalyst was positioned in close proximity to the open end of the combustion chamber. One end of the catalyst was in the reducing portion of the flame where carbon monoxide and hydrogen can exist and the other end of the catalyst was in the waste solution. The oxy-acetylene torch was ignited and the flame adjusted so that the reducing portion of the tip of the flame would touch the catalyst and the solution when the torch was submerged. The torch was submerged in the solution and left running for 25 minutes. A pocket of gas was formed within the combustion chamber. The gas generated by the heat of the oxy-acetylene flame at the interface of the flame and the surface of the waste solution at the open end of the combustion chamber bubbled out of the combustion chamber and rose to the surface of the waste solution and was collected in a gas absorption tower. The sparging solution of the gas absorption tower contains an aqueous solution of sodium hydroxide and hydrogen peroxide. The sparging solution for the absorption tower was prepared by dissolving 2.1g of sodium hydroxide pellets in 500ml of deionized water containing 1ml of 30% hydrogen peroxide. The absorption tower solution oxidizes the insoluble oxides of nitrogen contained in the gas generated by the heat of the oxy-acetylene flame to form soluble oxides of nitrogen which were absorbed in the solution and analyzed for nitrate content. After the test was completed the volume of solution remaining was measured and analyzed for nitrate content. The original waste solution contained 248,000 ppm nitrate present as sodium nitrate and after the test was completed the waste solution contained 246,255 ppm nitrate as sodium nitrate. The solution in the gas absorption tower contained 1,745 ppm nitrate after the test. The nitrate analyses and volume calculations indicate that nitrate ions were decomposed in the waste solution and removed as bubbles of gas migrating to the surface of the waste solution and collected in the gas absorption tower. These results indicate that the submergible torch of the instant invention works well in removing nitrate ions from a waste solution containing nitrate ions. The intermediate species, nitrite, if present, would also be reduced similarly since this species forms in solution just prior to the gaseous lower oxides.

The advantages of the present invention include:

(a) Thermal destruction/degradation of nitrate and/or nitrite ions in a waste solution without having to remove the water in the waste solution first is a large energy savings, especially if done in situ.

(b) The method provides for the scrubbing of the resulting gases by the original waste solution to remove particulates and volatile species at the same time as decomposition is effected.

(c) The process also permits the destruction of other species, if present, such as sulfate ions, or preferentially produce insoluble oxides of hazardous metals under the proper conditions, or thermally decompose hazardous organics under the proper conditions.

The present invention can be used for processing of solutions containing hazardous metals, organic or inorganic species of concern to man and biosphere.

While there has been shown and described what is at present considered the preferred embodiments of the invention, it will be obvious to those skilled in the art that various changes and modifications may be made therein without departing from the scope of the invention as defined by the appended claims.

What is claimed is:

1. A method for removing nitrate or nitrite ions from a waste solution comprising the following steps:

Step 1 - providing a waste solution comprising water and nitrate or nitrite ions and having a surface, a source of heat generating heat, and a catalyst;

Step 2 - submerging said source of heat generating said heat and said catalyst below said surface of said waste solution, said catalyst being located in close proximity to said heat source, said heat having a temperature sufficiently high to decompose nitrate or nitrite ions contained in said waste solution, said heat source and said catalyst being located sufficiently below said surface of said waste solution to provide a sufficient residence time for gases formed by heating of said waste solution by said heat from said heat source to be sufficiently contacted by said waste solution to remove essentially all volatile waste solution soluble species and to remove essentially all particles present in said gases formed by said heat from said heat source before said gases reach said surface of said waste solution; and Step 3 - maintaining said heat source generating said heat and catalyst below said surface of said waste solution for a period of time sufficient to decompose said nitrate or nitrite ions.

2. A method in accordance with claim 1 wherein said flame temperature is equal to or greater than the temperature required to decompose said nitrate or nitrite ions in said waste solution.

3. A method in accordance with claim 1 wherein said period of time in Step 3 is equal to or greater than the time required to decompose said nitrate or nitrite ions in said waste solution.

4. A method in accordance with claim 1 wherein said heat source comprises a submergible torch.

5. A method in accordance with claim 1 wherein said heat source comprises an ion plasma.

6. A method in accordance with claim 1 wherein said heat source comprises an electric arc.

7. A method in accordance with claim 1 wherein said catalyst comprises platinum black.

8. A method for removing nitrate or nitrite ions from a waste solution comprising the following steps:

Step 1 - providing a waste solution comprising water and nitrate or nitrite ions and having a surface;

Step 2 - igniting a fuel of a submergible torch to produce a flame;

Step 3 - submerging said submergible torch below said surface of said waste solution, said submergible torch comprising a combustion chamber having an open end and containing said flame, a catalyst being connected to said combustion chamber by a support in close proximity to said flame, said flame contacting said surface of said waste solution at said open end of said combustion chamber, said flame having a flame temperature sufficient to decompose said nitrate or nitrite ions in said waste solution, said submergible torch being located sufficiently below said surface of said waste solution to provide a sufficient residence time for gases formed by heating of said waste solution by said flame to be sufficiently contacted by said waste solution to remove essentially all volatile waste solution soluble species and to remove essentially all particles present in said gases formed by heating of said waste solution by said flame before said gases reach said surface of said waste solution; and Step 4 - maintaining said submergible torch below said surface of said waste solution for a period of time sufficient to decompose said nitrate or nitrite ions.

9. A method in accordance with claim 8 wherein said flame temperature is equal to or greater than the temperature required to decompose said nitrate or nitrite ions in said waste solution.

10. A method in accordance with claim 8 wherein said period of time in Step 4 is equal to or greater than the time required to decompose said nitrate or nitrite ions in said waste solution.

11. A method in accordance with claim 8 wherein said fuel comprises a mixture of an oxygen containing gas and a hydrogen containing gas selected from the group consisting of acetylene, propane, hydrogen, propylene, and mixtures thereof.

12. A method in accordance with claim 8 wherein said catalyst comprises platinum black.

* * * * *